United States Patent [19]

Hunter

[11] Patent Number: 4,834,289

[45] Date of Patent: May 30, 1989

[54] POP-UP SPRINKLER UNIT

[76] Inventor: Edwin J. Hunter, 5551 Codorniz Rd., Rancho Santa Fe, Calif. 92067

[21] Appl. No.: 174,240

[22] Filed: Mar. 28, 1988

Related U.S. Application Data

[63] Continuation-in-part of Ser. No. 49,843, May 15, 1987, Pat. No. 4,796,809.

[51] Int. Cl.[4] ..... B05B 15/10

[52] U.S. Cl. ..... 239/205; 239/206; 239/123; 239/114; 15/256.5

[58] Field of Search ..... 239/200, 201, 203, 204, 239/205, 206, 123, 114, 115; 15/256.5, 104.04; 285/302, 348, 354

[56] References Cited

U.S. PATENT DOCUMENTS

| | | | |
|---|---|---|---|
| 2,325,280 | 7/1943 | Scherrer | 239/204 |
| 2,884,654 | 5/1959 | Fall | 15/104.04 |
| 3,033,467 | 5/1962 | Hofer | 239/204 |
| 3,713,584 | 1/1973 | Hunter | 239/206 |
| 3,724,757 | 4/1973 | Hunter | 239/205 |
| 3,921,910 | 11/1975 | Hayes et al. | 239/205 |
| 3,934,820 | 1/1976 | Phaup | 239/205 |
| 4,113,181 | 9/1978 | Sheets | 239/206 |
| 4,316,579 | 2/1982 | Ray et al. | 239/206 |
| 4,353,506 | 10/1982 | Hayes | 239/206 |
| 4,609,146 | 9/1986 | Walto | 239/123 |
| 4,625,914 | 12/1986 | Sexton et al. | 239/206 |
| 4,699,321 | 10/1987 | Bivens et al. | 239/204 |

FOREIGN PATENT DOCUMENTS 1256534 12/1971 United Kingdom .

*Primary Examiner*—Andres Kashnikow
*Assistant Examiner*—Christopher G. Trainor
*Attorney, Agent, or Firm*—Baker, Maxham, Jester & Meador

[57] ABSTRACT

A pop-up sprinkler unit for mounting beneath the surface of a soil formation includes an outer cylindrical housing for subsurface mounting with an inner housing carrying a nozzle and drive turbine with a protective sleeve of a grit resistant material reciprocably mounted between the inner and outer housings for extending with the inner housing up through a portion of the soil and includes a grit deflector on the housing surrounding the sleeve for deflecting grit from between the sleeve and housing when the inner housing and sleeve is retracted.

20 Claims, 1 Drawing Sheet

FIG. 1
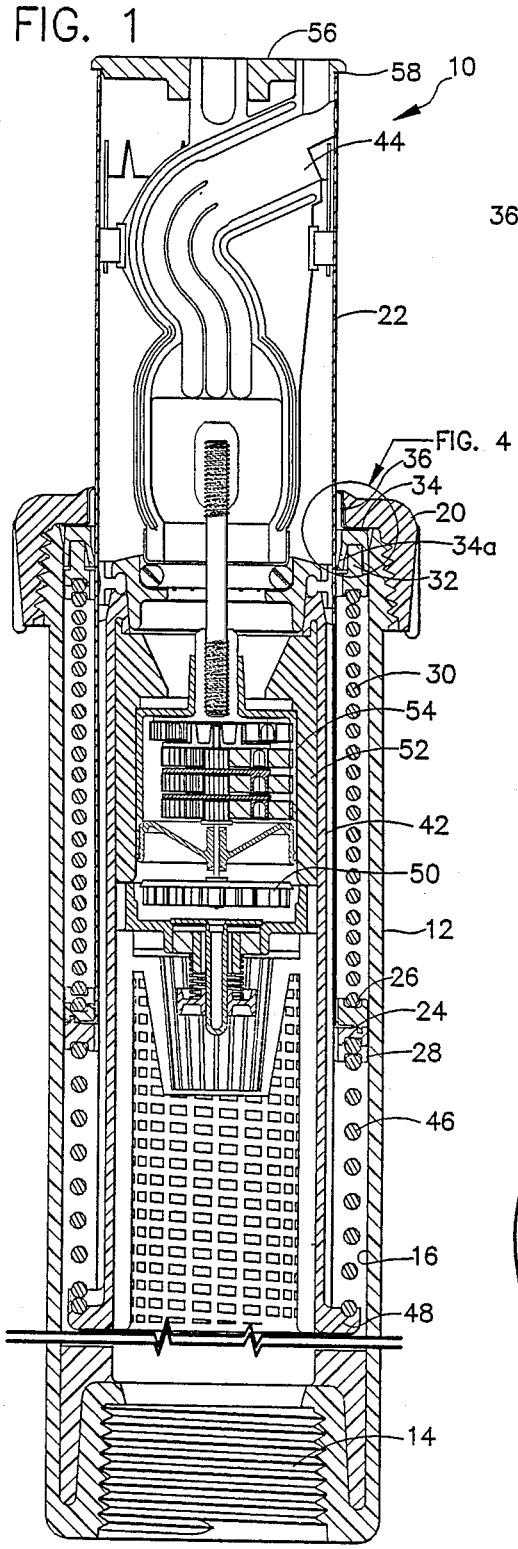
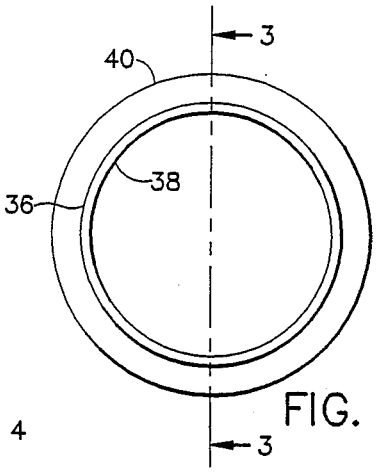
FIG. 2
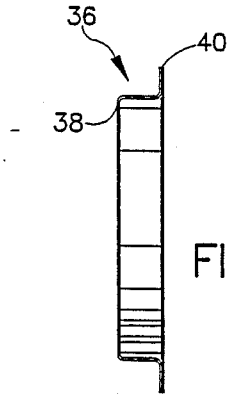
FIG. 3
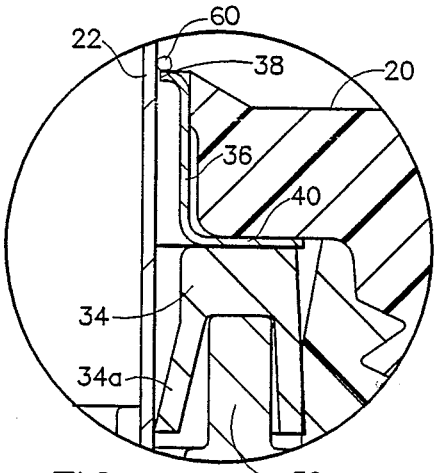
FIG. 4

POP-UP SPRINKLER UNIT

REFERENCE TO RELATED APPLICATIONS

The present application is a continuation-in-part of my co-pending application Ser. No. 049,843, filed May 15, 1987, now U.S. Pat. No. 4,796,809 and entitled "TWO-STAGE POP-UP SPRINKLER".

BACKGROUND OF THE INVENTION

The present invention relates to sprinkler units and pertains particularly to subsurface mounted pop-up sprinkler units.

In my prior aforementioned application, I disclose a pop-up sprinkler unit designed to be mounted beneath the soil surface, with a portion that pops-up through the soil and exposes the nozzle for distribution of the water. The pop-up unit retracts back through the soil to a position beneath the surface of the soil when not in use where it is covered by either vegetation or a layer of soil. The sprinkler unit was designed for use on playing fields and is fully retractable so as not to interfere with activities on the field.

Sprinkler units which retract into a housing in the ground when not in use, and which pop-up or extend from a housing to a position above the surface of the ground when water pressure is applied, are widely used in both residential and commercial applications. The most popular presently used sprinkler units are typically mounted in a protective well or housing, such that the top of the protective well of the sprinkler unit is typically at ground surface level. Such units are satisfactory for use around the periphery of a playing field where they are in an out-of-the-way place, such that they do not interfere with activity on the playing field. However, they are not satisfactory for use on playing fields.

In many applications, such as playing fields for sports and for golf courses and the like, it is desirable that the sprinkler unit be truly beneath the surface of the soil, so that it does not become an obstacle on the playing field. It is desirable that they be covered by either sod or soil, such that they do not interfere with normal activity on the playing field.

Attempts have been made in the past to solve this problem by providing subsoil mounted pop-up sprinkler units which pop-up through the soil to expose the nozzle. One such approach is illustrated in U.S. Pat. No. 1,853,805, issued Apr. 12, 1932 to Elder, entitled "Irrigating Sprinkler Apparatus". This patent disclosed an irrigating apparatus wherein the tubular nozzle is reciprocably mounted in a housing mounted beneath the soil. The tubular nozzle has an open upper end and a check valve closing the upper end until the tubular nozzle has extended to its extended position, at which a check valve opens to permit the flow of water from the upper end of the nozzle. However, the unit is subject to high wear and to jamming in the extended position. It also lacks an effective distribution nozzle and means for protectively mounting such a nozzle.

Another attempt at such devices is disclosed in U.K. Pat. No. 1256534, issued to Ede, and entitled "Improvements Relating To Spray Irrigation Units And Systems". This patent discloses a pop-up sprinkler unit wherein a first sleeve extends from a subsurface housing through a top surface of soil, and a final sleeve having ports therein extends from the first sleeve to distribute water. The housing and sleeves of the unit are disclosed as constructed of a plastic, such as PVC or the like. This unit is also subject to high wear and to jamming. The unit also fails to disclose a system which provides nozzles having good distribution.

The major problem with such known devices is that dirt, sand and grit from the surrounding soil get jammed between the relatively movable portions of the unit. Sand and grit also become embedded in the cylindrical sleeves and work past the seals into the area between the sleeve and housing. This results in the sleeve being jammed into position such that it will not retract. They also are subject to excessive wear between the sleeve and housing, resulting in excessive leaking.

It is, therefore, desirable that an effective pop-up sprinkler unit for subsurface mounting be available.

SUMMARY AND OBJECTS OF THE INVENTION

It is, therefore, the primary object of the present invention to provide an improved subsurface pop-up sprinkler unit.

In accordance with the primary aspect of the present invention, a subsurface pop-up sprinkler unit includes a grit resistant protective sleeve for protectively covering the nozzle while extending through the soil surface, and a grit deflector surrounding the sleeve for deflecting and excluding grit from the space between the housing and sleeve upon retraction of the nozzle and protective sleeve.

BRIEF DESCRIPTION OF THE DRAWING

The above and other objects and advantages of the present invention will become apparent from the following description when read in conjunction with the accompanying drawings wherein:

FIG. 1 is a side elevation view in section showing a preferred embodiment of the present invention;

FIG. 2 is a top plan view of a deflector of the unit of FIG. 1;

FIG. 3 is a section view taken on lines 3—3 of FIG. 2; and

FIG. 4 is an enlarged detail view showing a portion of the deflector and grit sleeve.

DETAILED DESCRIPTION OF A PREFERRED EMBODIMENT

An inner housing 42 is reciprocably mounted in the outer housing and supports a nozzle 44 and the necessary drive mechanism for the nozzle. The nozzle is rotated by means of turbine 50 and reduction gear drive 54 as more fully described in many of my prior patents.

Referring to FIG. 1 of the drawings, there is illustrated a pop-up sprinkler unit constructed in accordance with a preferred embodiment of the invention. The sprinkler unit, designated generally by the numeral 12, comprises a generally cylindrical outer housing 12, having an inlet opening or end 14 threaded for fitting to the end of a riser or the like for a source of pressurized water. An outlet end, which is normally oriented to be the top of the unit, is provided with a threadably mounted retaining cap 20, detachably mounted thereon by means of threads in a suitable manner.

A grit resistant tubular sleeve 22 is reciprocably mounted within a space between the inner housing 42 and the outer housing 12. The term "grit resistant surfaces", as used herein, means a surface having a hardness and finish such that it will resist scratches, abrasion and embedding of grit into the surface at operating forces and pressures. This could include certain plastics, such as acetel plastics, commonly sold under the Trademark Delrin, and exclude others. This sleeve, accordingly, is preferably constructed of a sheet metal having a hard grit resistant outer surface to enable it to move through a layer of soil without grit from the soil becoming embedded therein.

The sleeve is preferably constructed of a hard and durable sheet metal, such as stainless steel, to resist not only the abrasion from grit, but also rust, corrosion and the like. The sleeve is preferably on the order of between ten and thirty thousandths (0.010 to 0.030) and preferably approximately twenty thousandths (0.020) of an inch in thickness, and is formed with a radial flange 24 at a lower end, which is disposed between a pair of annular rings 26 and 28, which are mounted within the cylindrical bore 16 of the housing 12. The sleeve 22 serves as a protective cover for the nozzle and inner housing as it moves between extended and retracted positions. The thinness of the sleeve 22 enables the use of a nozzle and inner housing having an outer diameter almost equal to the bore of the outer housing.

The sleeve 22 and inner housing 42 are provided with retracting means in the form of axially aligned coil compression springs 30 and 46. The spring 30 is positioned between the retaining ring 26 and a ring 32 at the upper end of the housing 12, which biases against an annular seal 34, retained in position by the retaining cap 20. The spring 46 forms an extension of spring 30 and engages radial flange 46 on the inner housing 42. The two springs 30 and 46 bias against opposite sides of a common flange 24 on the sleeve 22. The sleeve floats on the two opposing springs between the outer and inner housings and occupies minimum space.

A grit deflector or excluder device 36 in the form of an annular ring member is mounted at the upper end of the housing, and includes an inwardly directed lip or deflecting edge 38 positioned in close proximity to the outer surface of the sleeve 22 for engaging and deflecting grit, sand and like particles from the outer surface of the sleeve 22 as it retracts into the housing. This deflector may be constructed of any suitable hard or non-elastic scratch resistant material, but is preferably constructed of a thin sheet metal, and again preferably of a hard durable non-corrosive metal, such as stainless steel.

The deflector has a preferred configuration, as illustrated, with a cylindrical sleeve central portion, with inwardly directed upper flange 38, and an outwardly extending lower flange 40. The inwardly directed flange 38 is fitted within a clearance of about one to about ten thousandths of an inch clearance from the outer surface of the sleeve 22. The deflector member is preferably formed of a sheet metal stamped in the illustrated configuration and of a material on the order of about ten to thirty thousandths of an inch in thickness.

Referring specifically to FIG. 4, it will be seen that the inwardly directed deflector edge 38 of the unit preferably extends at a slight angle to the horizontal, or more particularly a line perpendicular to the surface of the sleeve. The angle is such that the edge extends slightly upward toward the surface of the sleeve. This aids in the deflection of a grit or sand particle 60 from the sleeve surface and the area around the sleeve and edge 38. This deflector acts to exclude grit of a predetermined size from within the housing, and will permit grit of a smaller size (i.e. smaller than the clearance) to pass between the housing and the lip or flange 38.

The seal 34 is provided with a downwardly directed wiping lip or face 34*a*, which permits the grit to pass downward past the seal into the housing, and wipes the surface as the sleeve 22 is extended outwardly. The grit can then be flushed away by water in the housing. This construction excludes large grit and permits fine grit and particles to pass through the seal into the housing and be flushed out with minimal damage to the seal and the sleeve.

This construction enables the inner housing 42 and nozzle 44, while protected by the sleeve 22, to extend from the upper end of the housing, which is buried preferably a few inches beneath the surface of the ground. The sleeve 22 and housing 42 extend up through the soil to a position above the surface of the ground such that the nozzle, which is contained and sealed within the sleeve 22, can then be extended from the upper end thereof to enable it to distribute water in its selected pattern.

The inner sleeve or housing 42 carries a rotatable nozzle 44 and a drive mechanism for rotating the nozzle. The inner housing 42 is reciprocably mounted within the housing 12 and protected by the sleeve 22, and is retracted relative thereto by means of springs 30 and 46, which are coil compression type springs. The spring 46 engages and biases between the lower radial retainer flange 24 and a radial flange 48 on the lower end of the sleeve 42. The compression springs 30 and 46 are of the same diameter, and fit axially within the same annular space between sleeve 22 for supporting sleeve 22 by means of radial flange 24 therebetween. The sleeve 22 is essentially a protective sleeve that floats on and between the springs 30 and 46 between sleeve 42 and the housing 12. The sleeve 22 is maintained in its protective position over the nozzle until the last inch or so of extension of the inner housing 42 and the nozzle.

The nozzle 44 is rotatably mounted on the upper end of inner housing 42 on suitable support structure and is normally encased within the upper end of sleeve 22. The nozzle 44 is driven by means of a turbine wheel 50, rotatably mounted within an inner mounting sleeve 52 within the housing 42 and driving through a reduction gear assembly 54, comprising a plurality of reduction drive gears through a shaft 55 to the nozzle 44. The nozzle 44 is normally covered by or retracted within the sleeve 22 and is retained therein by means of the spring 46, which has a less strength than that of spring 30, such that the inner housing with the nozzle covered by sleeve 22 is first extended above ground level and when the spring 30 substantially bottoms out. The pressure within the system forces the inner housing 42 upward against spring 46 for extending the upper end of nozzle 44 upward beyond the upper end of sleeve 22. The nozzle is then above the surface of the ground and is exposed for operation.

A suitable cap 56 is mounted on the upper end of the nozzle 42, and has a radially extending lip 58 extending over the end of the sleeve 22 for sealing the upper end of the sleeve 22 when the nozzle is in the retracted position within the sleeve. The sprinkler unit is designed to be buried beneath the soil a sufficient distance to avoid interference with a playing field or the like. Preferably, a soil containing cup or the like (not shown) is mounted on the top of the cap 56 for containing sod or other suitable material conforming to and providing continuity of the surrounding surface area. With this arrangement, the sprinkler unit can be mounted such that it is fully retracted beneath the soil. The above combination of features, including the thin metal sleeve, enables compact and inexpensive construction of a unit.

In operation, when the sprinkler system is activated, pressurized water enters the inlet end of the housing 12, pressurizing the interior thereof, forcing the inner housing 42 and the protective sleeve 22 upward together through the soil to a position where the upper end thereof is above the surface of the formation, at which point the upper retracting spring 30 bottoms out, and the inner housing 42 continues to move upward to extend the upper end of nozzle 44 beyond the end of tube or sleeve 22 to expose or uncover the nozzle and enable the distribution of water. When the water supply is shut off, the pressure within the sleeves drops, and they begin retracting in reverse order with the inner housing and nozzle 44 first retracting into sleeve 22 where the nozzle is protectively covered.

As can be seen in FIG. 1, the inner housing 42 and nozzle 44 are greater in length than sleeve 22. The sleeve covers and protects the nozzle and upper portion of inner housing 42 during extension and retraction thereof.

The inner housing 42 retracts first, drawing the nozzle 44 into the sleeve 22 where it is protected. As the housing 42 and sleeve 22 are retracted further, soil and grit on the outer surface of sleeve 22 will be at least partially deflected or excluded by the deflector edge 38.

The combination of the grit deflector and hard surface construction of the sleeve 22 enables the sprinkler unit to operate indefinitely in the soil without jamming or excessive wear. A similar unit to that described herein has been tested for a period of approximately six months without encountering jamming or excess wear.

While I have illustrated and described my invention by means of specific embodiments, it is to be understood that numerous changes and modifications can be made therein without departing from the spirit and scope of the invention.

I claim:

1. A pop-up sprinkler unit for burying beneath the surface of the soil of an earth formation comprising:

an elongated outer housing member having a cylindrical through bore extending from an inlet for connecting to a source of water to an outlet end for receiving a retractable nozzle;

an elongated inner hosing having said nozzle mounted on an upper end thereof reciprocably mounted in said bore and movable between a retracted position within said bore and an extended position wherein said upper end and said nozzle is extended from said outlet end of said bore;

an elongated grit resistant tubular sleeve having an inner end and an outer end, retractably mounted in said bore and extending between said inner housing and said outer housing and normally biased to a protective position covering said nozzle, and responsive to a source of pressurized water to extend with said inner housing to a first extended position through a covering earth formation from said bore; and excluder means defined by a non-elastic annular edge surrounding said sleeve in spaced non-engaging relation thereto at said outlet end of said housing for excluding grit and the like particles from said housing and wherein said excluder means comprises a generally tubular central portion having an outer end and an inner end, and a radially inwardly extending annular flange at said outer end.

2. A sprinkler unit according to claim 1 wherein:

said annular edge having a width of from about 0.010 to about 0.030 inches and a clearance from said sleeve of on the order of from about 0.0010 to about 0.010 inches.

3. A sprinkler unit according to claim 2 wherein:

said sleeve and said excluder means formed of seamless sheet metal.

4. A sprinkler unit according to claim 3 wherein:

said sheet metal is stainless steel.

5. A sprinkler unit according to claim 1 wherein:

said excluder is constructed of sheet material.

6. A sprinkler unit according to claim 5 wherein:

said sheet metal is stainless steel.

7. A sprinkler unit according to claim 1 wherein:

said sleeve and said excluder means are formed of sheet metal having a thickness of on the order of 0.010 and 0.030 inches.

8. A sprinkler unit according to claim 7 wherein:

said sleeve and said excluder means are stainless steel.

9. A sprinkler unit according to claim 8 further including radially outwardly extending annular flange at said inner end.

10. A sprinkler unit according to claim 2 further including a radially outwardly extending annular flange at said inner end.

11. A pop-up sprinkler unit for burying beneath the surface of the soil of an earth formation comprising:

an elongated tubular outer housing member having a coaxial through bore communicating from an inlet for connecting to a source of water to an outlet end for receiving a retractable nozzle;

an elongated inner housing having a nozzle mounted on an upper end thereof reciprocably mounted in said bore and movable between a retracted position within said bore and an extended position wherein said upper end and said nozzle is extended from said outlet end of said bore;

an elongated grit resistant tubular sleeve having an inner end and an outer end, retractably mounted in said bore and extending between said inner housing and said outer housing and normally biased to a protective position covering said nozzle and responsive to a source of pressurized water to extend with said inner housing to a first extended position through a covering earth formation from said bore; and an annular excluder surrounding said sleeve at said outlet end of said housing, said excluder comprises an a non-elastic annular edge having a width of from about 0.010 to about 0.030 inches and extending toward and spaced from said sleeve with a clearance from said sleeve of on the order of from about 0.0010 to about 0.010 inches for excluding grit and the like particles from said housing and wherein said excluder means comprises a generally tubular central portion having an outer end and an inner end, and a radially inwardly extending annular flange at said outer end defining said edge.

12. A sprinkler unit according to claim 11 wherein:

said sleeve and said excluder are formed of seamless sheet metal.

13. A sprinkler unit according to claim 12 wherein:

said sheet metal is stainless steel.

14. A sprinkler unit according to claim 13 further including: a radially outwardly extending annular mounting flange at said inner end.

15. A sprinkler unit according to claim 11 wherein:

said excluder comprises a generally tubular central portion having an outer end and an inner end, a radially inwardly extending annular flange at said outer end defining said edge, and a radially outwardly extending annular flange at said inner end.

16. A multi-stage pop-up sprinkler unit comprising:

an elongated outer tubular housing having a cylindrical bore with inlet means for attachment to a source of pressurized water and outlet means communicating with said bore;

an elongated inner tubular housing having a nozzle mounted on an upper end thereof reciprocably mounted in said cylindrical bore for movement between a retracted position wherein said nozzle is encased within said outer tubular housing and an extended position wherein said nozzle is cooperatively extended from said outer tubular housing;

elongated tubular sleeve means reciprocably mounted in and disposed between said outer housing and said inner housing for movement with said inner housing between a retracted position and a first extended position extending from the outlet end of said bore;

an annular excluder surrounding said sleeve at said outlet end of said housing, said excluder comprises a non-elastic annular edge having a width of from about 0.010 to about 0.030 inches and extending toward and spaced from said sleeve with a clearance from said sleeve of on the order of from about 0.0010 to about 0.010 inches for excluding grit and the like particles from said housing upon retracting said inner housing and sleeve into said bore.

17. A sprinkler unit according to claim 16 wherein: said sleeve and said excluder are formed of seamless sheet metal.

18. A sprinkler unit according to claim 17 wherein: said sheet metal is stainless steel.

19. A sprinkler unit according to claim 18 wherein: said sheet metal has a thickness of on the order of about 0.010 to about 0.030 inches.

20. A sprinkler unit according to claim 17 wherein: said sheet metal has a thickness of on the order of about 0.10 to about 0.30 inches.

* * * * *